United States Patent [19]

Von Holdt

[11] Patent Number: 4,512,494

[45] Date of Patent: Apr. 23, 1985

[54] PLASTIC CONTAINER HAVING TONGUE AND GROOVE RETENTION

[76] Inventor: John W. Von Holdt, 6864 Lexington La., Niles, Ill. 60648

[21] Appl. No.: 470,555

[22] Filed: Feb. 28, 1983

[51] Int. Cl.[3] ..... B65D 55/16

[52] U.S. Cl. ..... 220/307; 220/306; 220/354

[58] Field of Search ..... 220/307, 306, 354

[56] References Cited

U.S. PATENT DOCUMENTS

| | | | |
|---|---|---|---|
| 2,885,108 | 5/1959 | Donoghue | 220/354 |
| 3,117,691 | 1/1964 | Williams | 220/306 |
| 4,210,258 | 7/1980 | Von Holdt | 220/307 X |
| 4,397,404 | 8/1983 | Blanchette | 220/306 |

*Primary Examiner*—Steven M. Pollard
*Attorney, Agent, or Firm*—Charles F. Pigott, Jr.

[57] ABSTRACT

A plastic container and removable interlocking lid where the upper end of the container includes radially outer and radially inner upright annular flanges together with a bottom wall which forms a U-shaped annular rim defining an upwardly facing annular trough. The lid includes a first radially outer depending annular wall which fits down within the U-shaped annular rim and locks therein for removably locking the lid to the top of the container. The upwardly facing trough includes at least one annular groove the upper end of which is defined by a substantially flat surface which locks against a substantially flat annular shoulder formed on the first depending lid wall. In a preferred form, the base of the trough is formed of a plurality of sloping surfaces, and drain holes are located in the trough in communication with the interior of the container, the drain holes being located at the lower portions of the sloping surfaces.

4 Claims, 9 Drawing Figures

FIG. 1
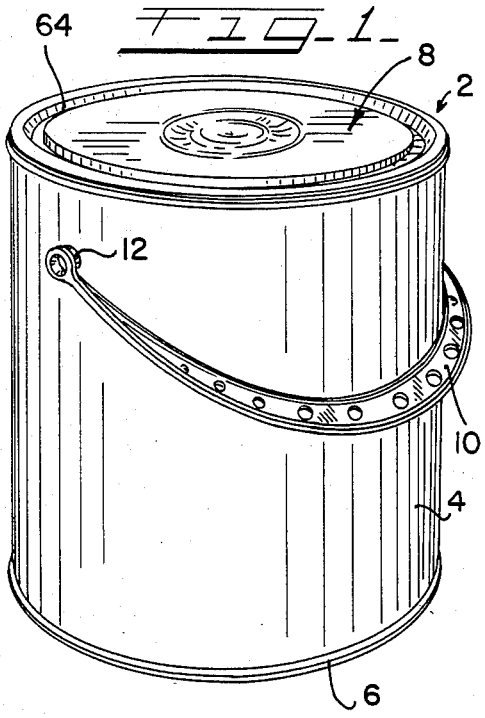
FIG. 3
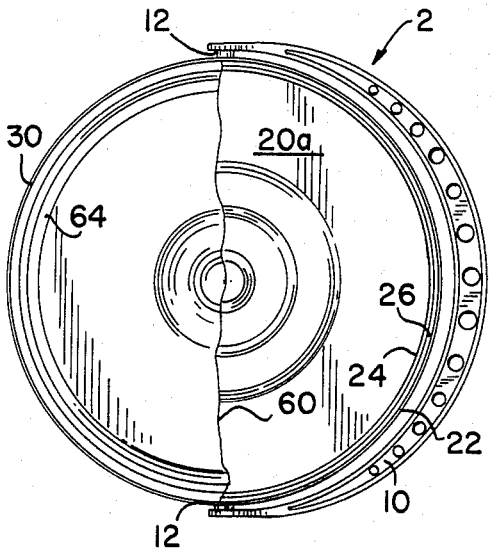
FIG. 9
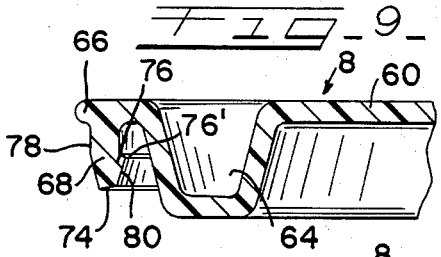
FIG. 2
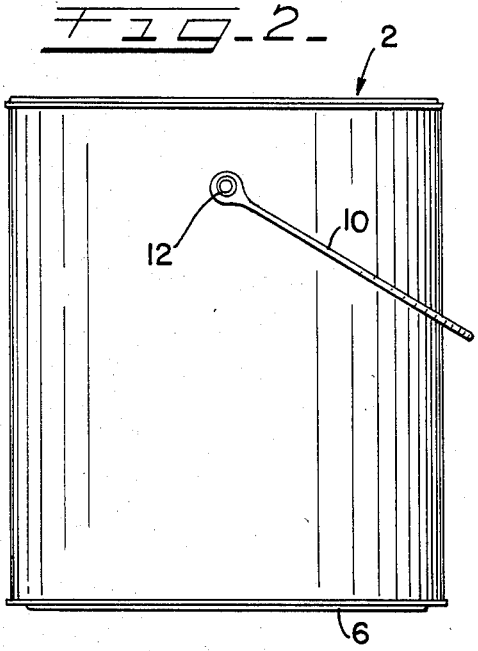
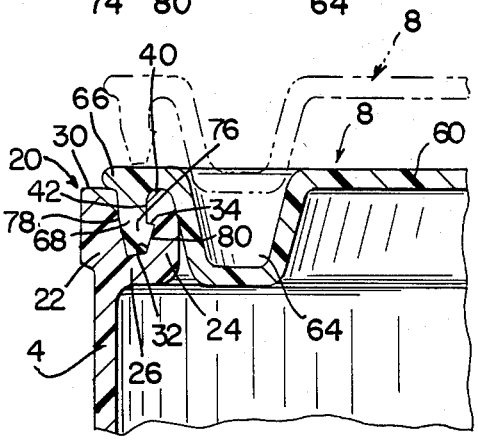
FIG. 4

PLASTIC CONTAINER HAVING TONGUE AND GROOVE RETENTION

BACKGROUND OF THE INVENTION

This invention relates in general to containers, more specifically, to an improved plastic container.

More specifically, without reference to the particular use which is shown and described, the invention relates to an improved plastic container capable of superior retention of its lid through novel locking engagement between lid and container. The container of the invention is further provided with means to prevent the accumulation of liquid within its upper rim and is effectively resistent to leakage or seepage.

At present, the use of containers, cans, buckets and other receptacles formed from plastic is rapidly gaining widespread recognition. Plastic buckets have been found to be attractive containers for paint and other material and have demonstrated distinct advantages over the traditional metal cans commonly used in the past. Such benefits include corrosion and dent resistance, light weight and reusability among benefits. To satisfactorily serve as a can for paint, for example, a plastic container must demonstrate adequate strength to resist breaking, if dropped or subject to other impact. A plastic container must also be of a design capable of retaining the lid in a manner to minimize leakage of the liquid contents and to preserve a locked configuration under extreme handling or shock conditions.

In the paint industry, strength and the prevention of leakage is a particularly important factor, because paint cans are often subject to rough handling at the plant, during transport and storage, and at the retail store. Paint containers must be capable of withstanding filling machines, various adverse transport conditions, shaking machines and other such circumstances. In use, paint cans must also be opened and closed without effort. When recapped by the user, the lid must still be effectively retained against dislodgement and leakage, features not optimumly found in some prior containers.

During painting, known designs of both metal and plastic cans collect the liquid contents through spillage into a channel formed on the top rim. Paint is accumulated in this trough during insertion and removal of the brush, pouring, and the like. The presence of paint in the rim of the can is not only messy, but deters proper recapping. Painters and some container designers have previously provided holes in the channel to drain paint back into the can, but these measures are ineffective. Surface tension prevents proper drainage through the ports, and much of the paint is retained in the channel.

Prior plastic designs further in general do not attain the desirable objectives of effective retention of lid to rim for prevention of separation and leakage, while permitting convenient use, opening and closing. It is advantageous that such features be incorporated in a can that is inexpensive to make, convenient to use and may be stored with greater efficiency.

SUMMARY OF THE INVENTION

It is, therefore, an object of this invention to provide improved plastic containers.

Another object of the present invention is to provide a plastic container in which the lid is effectively retained by a tongue and groove-type design.

A still further object of this invention is to provide a plastic container having a lid capable of being retained in a wide range of diverse conditions without leakage or seepage.

Still another object of this invention is to provide a lid and container design by which lids may be automatically engaged by the can with ease during capping at the plant or subsequent resealing.

Still another object of this invention is to provide means to drain liquid accumulated in the upper rim of the container.

Another object of this invention is to permit drainage of accumulated liquid in a container trough by the use of sloped surfaces for directing the liquid to drain holes appropriately positioned at low elevations.

These and other objects are attained in accordance with the present invention wherein there is provided an improved container can including a molded rim structure having a continuous annular trough around the top of the can. The trough is defined by a pair of spaced annular lips, providing sidewalls, and a bottom wall. The lips are designed to engage the downward, annular projection of a lid in a unique manner providing for suitable capping pressure and for effectively retaining the lid after attachment. The downward annular projection of the lid engages the rim structure of the container within its continuous trough by an action, similar to a tongue and groove arrangement, on one or two sides. The improved design of the downward projection of the lid permits deflection by a camming action of one or both lips associated with the can rim structure and causes the one or two tongues or projecting flanges of the lid to engage the corresponding grooves in the lips of the can.

A series of holes extend through the bottom of the trough to provide drainage of liquid back into the container. The efficiency of drainage is enhanced by the invention of the application by the bottom wall of the trough being formed with a series of sloped surfaces, such that the ports are generally positioned at the interface between the inclined surfaces at the lowermost elevations of the trough. The improved interconnection of the lid with the lip structure of the bucket herein disclosed insures sealing at multiple areas, such that leakage and seepage of paint or other liquid material from the container is largely alleviated.

DESCRIPTION OF THE DRAWINGS

Further objects of the invention together with additional features contributing thereto and advantages accruing therefrom will be apparent from the following description of preferred embodiments of the invention which are shown in the accompanying drawings with like reference numerals indicating corresponding parts throughout, wherein:

FIG. 1 is a perspective view of the plastic container of the invention having its lid in a closed engaged position;

FIG. 2 is a side elevational view of a plastic container of FIG. 1;

FIG. 3 is a top plan view with portions of the lid broken away to expose the upper rim structure of the plastic container;

FIG. 4 is an enlarged fragmentary sectional view of a first embodiment of the plastic container of the invention showing a single sided tongue and groove-type interconnection with a lid and showing a lid in phantom in stacked relationship thereon;

DESCRIPTION OF THE PREFERRED EMBODIMENTS

Figure 5:
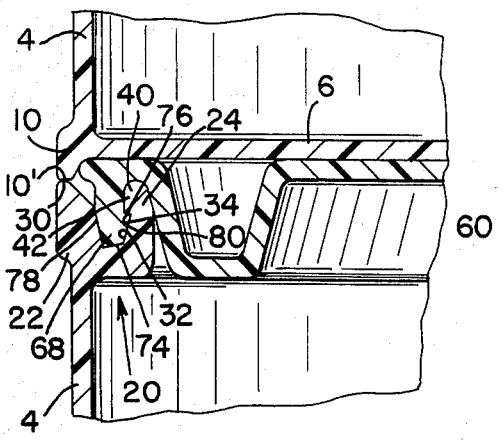
FIG. 5 is an enlarged fragmentary sectional view as similarly illustrated in FIG. 4 showing the stacking relationship of a plurality of containers.

Referring now to FIGS. 1–3, there is illustrated the plastic container or bucket of the invention molded from a plastic material by an appropriate technique and generally designated by the reference numeral 2. Although the container of the invention may be manufactured by any one of a number of molding procedures, the collapsible molding technique disclosed and claimed in my co-application for a Simplified Collapsible Mold Core and filed on Dec. 27, 1982, Ser. No. 453,320, is suitable.

In FIGS. 1–3, the container 2 is shown as possessing a generally cylindrical configuration, although it may be constructed in other shapes, if desired. As is conventional in cylindrical receptacles, the container 2 is formed as a continuous annular body or wall 4 having an integral, permanent bottom 6 and an upper removal lid 8. As shown in FIG. 5, the bottom 6 of the container 2 integrally merges wth annular wall 4 through a lower annular section 10. Lower annular section 10 provides an increased thickness as well as both outwardly and downwardly projecting flanges between the bottom wall 6 and annular wall 4 of the container to increase the strength of the design, and to provide a bottom surface 10′ for elevating the bottom wall 6 and for attaining efficient stacking as will be described. A pivotal handle 10 is affixed to the sockets or "ears" 12 molded on the sidewall of the container. (FIGS. 1–3).

Referring now to FIGS. 3, 4, 7 and 8, there is shown the integral rim or lip structure 20, which continuously extends around the upper edge of container 2 adjacent container opening 20*a*. The rim structure includes an outer annular wall forming a continuous inner lip 24. The lips 22 and 24 are interconnected at their bottom portions by a bottom wall structure 26 and create a continuous annular trough 28 around the upper portion of the container as is well-known in paint cans. The integral outer lip 22 projects laterally outward from the sidewall 6 of the container 2 and possesses an increased thickness to enhance strength characteristics for retention of the lid and provide for improved stacking of the container when desired. The top surface 30 of the outer lip 22 provides an area projecting radially outward beyond the lid 8 and is adapted to contact the bottom of the lower annular section 10 of another container 2 stacked thereon as shown in FIG. 5. Surface 30 facilitates the stacking of a number of containers 2, with or without the lid in tact, for efficient storage and transport as is desirable. The greater lateral thickness of the design of the outer lip 22 provides increased strength for stacking of large numbers of containers on each other.

As stated previously, the inner wall of the trough 28 is formed by the inner lip 24 which is spaced from the outer lip 22. As seen in FIGS. 4 and 5, the bottom wall structure 26 extends inwardly of the opening 20*a* at the top of the container 2, such that the inner lip 24 is positioned radially inward from the sidewall 6 as well as from the outer lip 22. The upper edges of the lips 22 and 24 form the upper opening of trough 28 into which an annular projection of the lid may be inserted for automatic retention within the trough as will be described. In the embodiment of FIGS. 4 and 5, a lower groove 32 is provided in the trough facing surface of inner lip 24 and has a downward facing groove surface 34 in the form of an abutment shoulder. The groove 32 slopes downward from the shoulder 34 and terminates adjacent the bottom wall structure 26. The upper portion of the inner lip 24 includes a rounded top edge portion 40 and an inner surface 42. The inner surface 42 is arranged to engage lid 8 in a manner that the upper portion of the lip 24 is deflected inward during capping of the lid through a camming action, until such time as the lid and groove are automatically locked as will be apparent.

Figure 7:
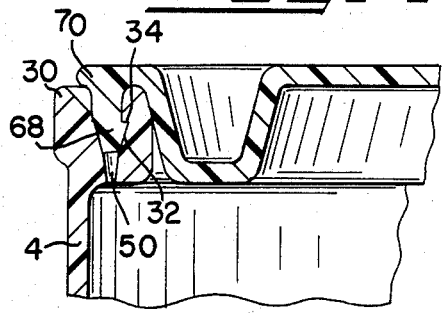
FIG. 7 is an enlarged fragmentary sectional view of the container of FIG. 4 in which the lower wall of the trough includes a plurality of drainage apertures; and, FIG. 8 is a perspective view of the sloped bottom wall of the trough with drainage apertures as shown in FIG. 7.
Figure 8:
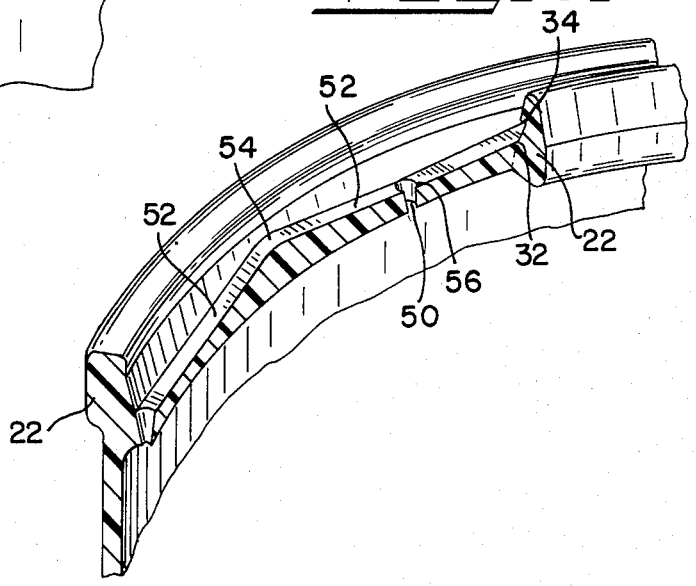

Although the bottom structure 26 of the trough can be generally flat, it may also be alternatively formed in the configuration shown in FIGS. 7 and 8, in which provision for the automatic drainage of any fluid within the trough is made. In FIGS. 7 and 8, a plurality of holes or ports 50 are formed through the bottom wall 26 and create fluid communication between the trough 28 and the interior of the container 2. To facilitate removal of excess liquid from the trough 28 through apertures 50, the bottom wall structure 26 has an upper contour having a series of oppositely inclined surfaces 52 arranged continuously around the container to form a number of apexes 54 and lowermost points 56, at which a respective hole 50 is generally positioned. In use of the invention, the holes 50 may be positioned at the lowermost points at the interface between inclined surfaces at some or all of the lowermost elevations 56 of the trough.

Referring now to FIGS. 1, 3, 4, 5 and 7, the configuration of the lid 8 is best illustrated. The lid 8 possesses a generally circular, disc-like shape 60 having an annular channel 64 located near its peripheral edge to strengthen the lid structure and provide better sealing between the rim structure of the container and the lid in a retained position. As shown in FIG. 4, the outer peripheral edge portion 66 of the lid 60 is provided with a continuous, annular member 68 which forms a continuous downward projection beneath the lid in a closed configuration thereof. The projection 68 is arranged to be inserted into the trough 28 in a manner that the lid is automatically retained on container 2 with ease of capping or resealing. The outer peripheral edge 70 of the lid 8 protrudes outward and has a lower flange to seat on a portion of the top surface of the outer lip 22 of the container 2 in the retained position shown in FIG. 4.

In the embodiment shown in FIGS. 4, 5 and 7, the outer surface 72 of the lid annular member 68 has a configuration generally corresponding to the shape of the inner surface of the outer lip 22. The bottom edge of the projecting member 68 may include a slightly inclined, wedge-like end portion 74. The bottom edge 74 is arranged to contact the apexes 54 provided on the bottom wall structure 26 of the container rim. The bottom edge 74 is further capable of attaining a sealed relationship with the apexes 54 to prevent seepage from the content of the can 2.

The inner surface of the annular projecting member 68 is formed with a lower barbed-like tongue or projection 76 bulging radially inwardly from a mid-portion and sloping outward toward the bottom edge 74 to form a camlike surface 80. Tongue or annular shoulder 76 forms an upper flange surface 76' for engaging shoulder 34 provided in the groove of inner lip 24 of the container 2. When the annular member 68 is in the position shown in FIGS. 4, 5 and 7, the flange or shoulder 76' engages shoulder 80 with a locking action to retain the lid on the container subsequent to insertion of the annular projection 68 into the trough 26. For superior locking, it is desirable that flange 76' be approximately flat and inclined to be horizontal in the range of 0° to 48°, with an inclination angle of 10° being optimum. The cam shape of surface 80 of the annular projections 68 forms a leading edge arranged to contact the upper surface 42 of the inner lip 24 during insertion and deflect it inward through a camming action, so that the tongue 76 can be positioned in the groove 32. The tongue 76 and lip 24 snaps into engagement to create an automatic locking action between lid and container.

The bottom portion of the outer surface 78 of the annular member also creates some camming action in the embodiments of FIGS. 4, 5 and 7, to aid in the ease of insertion of the projecting member. Upon being engaged, the annular projection 68 is disposed in trough 26 in a sealed relationship, and the inner lip is then positioned between the annular member 68 and the sidewall forming channel 64. This unique interrelationship of lid and container through a double-walled lip structure not only provides superb retention, but also enhances sealing, because the projecting member is pressing in engagement with the inner and outer lips at a plurality of points to prevent leakage and seepage from the container after the lid is closed.

From the foregoing, it should be clear that the lid projection 68 snaps into position into the trough 28 upon the insertion thereof by a suitable recapping pressure through the camming action of the leading edge surfaces of the annular member 68. The embodiments of FIGS. 4, 5 and 7, rely on a tongue and groove arrangement for retention on a single side, i.e., on the inner surface of the annular member of the lid and inner lip 24. The channel 64 of lid 8 may be reinforced by optional ribs arranged about the lid. The presence of ribs increases the strength of the lid and may increase the necessary capping pressure to retain a lid. It should also be noted that lids 8 may be stacked as shown in phantom in FIG. 4 to facilitate use in the capping machine at the factory and the like.

Figure 6:
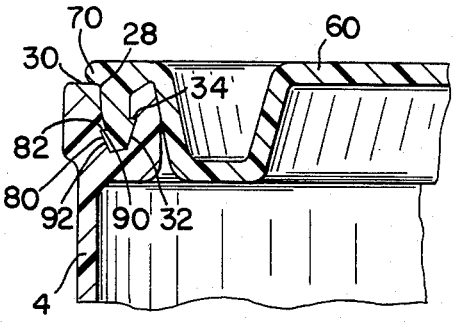
FIG. 6 is an enlarged fragmentary sectional view of a second embodiment of the plastic container of the invention attaining two-sided retention of the lid.

Referring now to FIG. 6, there is illustrated another embodiment of the invention in which a second tongue and groove arrangement is provided on the outer surface of the projecting member 68 of the lid. A continuous groove 80 having a stop shoulder 82 is formed within the inner wall of the outer lip 22 and is arranged to engage a tongue or shoulder 90 formed on the outer surface of the annular lid member 68. The elevation of the stop shoulder 90 with respect to the stop shoulder 34 may be different to enhance the action of retention. In the embodiment of FIG. 6, the lower portion of the outer surface 90 of the annular lid member 68 cams the outer lip 22 outward in a similar action as the inner lip 24 being cammed inward by the lower surface 80 of the inner portion, such that a double acting tongue and groove retention is attained. This is desirable in certain applications when increased retention of the lid 8 is desirable in accordance with encountered conditions.

While the invention has been described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims.

What is claimed is:

1. A plastic container and removable interlocking lid comprising, in combination, a container body having a circular cross-section and having a bottom wall and an open top, said top of said container body comprising a generally U-shaped annular rim defining an upwardly facing trough, said U-shaped annular rim including an outer upright annular flange, an inner upright annular flange spaced radially inwardly from said outer flange, and a bottom wall, said outer and inner annular flanges and said bottom wall defining said upwardly facing annular trough, at least one of said outer and inner annular flanges having an annular groove formed on the wall facing said trough, said groove being defined at its upper end by a substantially flat annular surface inclined at an angle of from 0 degrees to 48 degrees from the horizontal, and said lid comprising a first radially outer depending wall dimensioned to fit and lock within said trough between said first and second annular flanges, said first depending wall having an annular substantially flat shoulder inclined at an angle to the horizontal substantially matching the angle of said flat annular surface defining said groove so as to engage against said flat annular surface thereby releasably locking said lid to the top of said container, a second depending annular wall on said lid positioned to contact and seal against the radially inner surface of said inner annular flange when said lid is pressed into locking relation with said top of said container, and a third depending annular wall on said lid spaced radially inwardly from said second wall and integrally connecting said second wall with a top surface of said lid, a plurality of drain holes being formed in the base of said trough to communicate with the interior of said container, the base of said trough comprising a plurality of abutting sloping surfaces forming circumferentially alternating apexes and lower portions, said drain holes being located adjacent lower portions of said sloping surfaces.

2. A plastic container and removable interlocking lid as defined in claim 1 where said substantially flat annular surface is inclined at an angle of approximately 10 degrees from the horizontal.

3. A plastic container and removable interlocking lid as defined in claim 1 where both said inner and outer flanges have an annular groove formed on a wall facing said trough, each of said grooves being defined at its upper end by a substantially flat annular surface inclined at an angle of from 0 degrees to 48 degrees from the horizontal, and said first depending wall of said lid has an annular substantially flat shoulder on both its radially inner and its radially outer surfaces inclined at angles to match the angle of the adjacent flat annular surface defining said groove so as to engage against a corresponding flat annular surface thereby releasably locking said lid to the top of said container.

4. A plastic container and removable interlocking lid as defined in claim 3 where the annular flat shoulder on the radially outer side of said first depending lid wall is at a lower level than the annular flat shoulder on the radially inner side of said first depending lid wall.

* * * * *